US012655534B2

(12) United States Patent
Lovrak et al.

(10) Patent No.: US 12,655,534 B2
(45) Date of Patent: Jun. 16, 2026

(54) ANODE WITH METALLIC INTERLAYER FOR ELECTRODEPOSITION

(71) Applicant: Magneto Special Anodes B.V., Schiedam (NL)

(72) Inventors: Matija Lovrak, The Hague (NL); Adriaan Jeremiasse, GN Rotterdam (NL)

(73) Assignee: Magneto Special Anodes B.V., Schiedam (NL)

( * ) Notice: Subject to any disclaimer, the term of this patent is extended or adjusted under 35 U.S.C. 154(b) by 0 days.

(21) Appl. No.: 18/867,096

(22) PCT Filed: Apr. 21, 2023

(86) PCT No.: PCT/EP2023/060518

§ 371 (c)(1),
(2) Date: Nov. 19, 2024

(87) PCT Pub. No.: WO2023/203231

PCT Pub. Date: Oct. 26, 2023

(65) Prior Publication Data

US 2025/0215596 A1 Jul. 3, 2025

Related U.S. Application Data

(60) Provisional application No. 63/333,511, filed on Apr. 21, 2022.

(51) Int. Cl.
*C25D 3/02* (2006.01)
*C25D 3/04* (2006.01)
(Continued)

(52) U.S. Cl.
CPC ..... *C25D 3/06* (2013.01); *C25D 17/12* (2013.01)

(58) Field of Classification Search
CPC ... C25D 3/04; C25D 3/22; C25D 3/30; C25D 3/38; C25D 5/00; C25D 17/10; C25D 3/02; C25D 3/56; C25D 3/58; C25D 3/60
(Continued)

(56) References Cited

U.S. PATENT DOCUMENTS

| | | | | |
|---|---|---|---|---|
| 8,337,958 | B2 | 12/2012 | Cao | |
| 2009/0246410 | A1 | 10/2009 | Cao | |
| 2010/0108532 | A1 * | 5/2010 | Pearson | C25D 3/06 205/284 |

FOREIGN PATENT DOCUMENTS

| | | | | |
|---|---|---|---|---|
| CN | 102560561 | A | 7/2012 | |
| GB | 2290553 | A * | 1/1996 | C25D 17/10 |

(Continued)

OTHER PUBLICATIONS

ATI, "Corrosion Resistant Titanium," Technical Data Sheet, Version 2 (Feb. 26, 2013), pp. 1-5. (Year: 2013).*

*Primary Examiner* — Edna Wong
(74) *Attorney, Agent, or Firm* — Kolitch Romano Dascenzo Gates LLP

(57) ABSTRACT

A method of facilitating electrolytically depositing chromium onto a metal substrate from an electrolyte including an ionic form of chromium and one or more organic additives in an electrodeposition vessel by applying a current through the electrolyte from an anode to the metal substrate to deposit the chromium on the metal substrate. The method comprises providing the anode, the anode including a core comprising a valve metal, an interlayer disposed on the core and comprising one of a titanium-tantalum alloy or a titanium-palladium alloy, and a catalyst material layer disposed on the interlayer.

9 Claims, 3 Drawing Sheets

(51) Int. Cl.

| | |
|---|---|
| ***C25D 3/06*** | (2006.01) |
| ***C25D 3/22*** | (2006.01) |
| ***C25D 3/30*** | (2006.01) |
| ***C25D 3/38*** | (2006.01) |
| ***C25D 3/56*** | (2006.01) |
| ***C25D 3/58*** | (2006.01) |
| ***C25D 3/60*** | (2006.01) |
| ***C25D 5/00*** | (2006.01) |
| ***C25D 17/10*** | (2006.01) |
| ***C25D 17/12*** | (2006.01) |

(58) Field of Classification Search
USPC ..... 205/238, 261, 284, 290, 292, 296, 302, 205/311, 239, 240, 241, 242, 243, 244, 205/253
See application file for complete search history.

(56) References Cited

FOREIGN PATENT DOCUMENTS

| | | | |
|---|---|---|---|
| JP | H02263999 | A | 10/1990 |
| JP | H05171483 | A | 7/1993 |
| JP | H0813199 | A | 1/1996 |
| JP | H08199384 | A | 8/1996 |
| JP | 2009263770 | A | 11/2009 |
| JP | 2011140700 | A | 7/2011 |

* cited by examiner

ANODE WITH METALLIC INTERLAYER FOR ELECTRODEPOSITION

FIELD OF THE DISCLOSURE

Aspects relate generally to electrode coatings and, more particularly, to two layered electrode coatings, their method of preparation, and use.

SUMMARY

In accordance with one aspect, there is provided a method of facilitating electrolytically depositing chromium onto a metal substrate from an electrolyte including an ionic form of chromium and one or more organic additives in an electrodeposition vessel by applying a current through the electrolyte from an anode to the metal substrate to deposit the chromium on the metal substrate. The method comprises providing the anode, the anode including a core comprising a valve metal, an interlayer disposed on the core and comprising or consisting of one of a titanium-tantalum alloy or a titanium-palladium alloy, and a catalyst material layer disposed on the interlayer.

In some embodiments, the anode is provided having the core comprised of titanium.

In some embodiments, the anode is provided having the catalyst material layer comprised of a mixed metal oxide of iridium and tantalum.

In some embodiments, the anode is provided having the catalyst material layer comprised of one or more of platinum, iridium, iridium oxide, ruthenium, ruthenium oxide, palladium, tantalum, or tantalum oxide.

In some embodiments, the anode is provided having the catalyst material layer comprising between 3 g/m$^2$ and 70 g/m$^2$ of iridium, for example, comprising about 10 g/m$^2$ of iridium.

In some embodiments, the anode is provided having the interlayer comprising titanium and tantalum in a weight ratio of from 30:70 to 70:30.

In some embodiments, the anode is provided having the catalyst material layer comprised of iridium and tantalum in a mass ratio in a range of from 9:1 to 2:1.

In some embodiments, the one or more organic additives includes one of formic acid or a sulfonic acid.

In some embodiments, providing the anode includes providing the anode with a configuration and composition configured to pass a greater amount of electric charge, in MAh per m$^2$ of anode area, without failure of the anode than an anode having either no interlayer or an interlayer formed of titanium oxide or tantalum oxide.

In some embodiments, providing the anode includes providing the anode with a configuration and composition configured to pass over 50 MAh per m$^2$ of anode area prior to failure of the anode.

In some embodiments, the electrolyte has a pH of between less than zero and 4, between 0 and 4, between 1 and 4, or between 2.5 and 3.5.

In accordance with another aspect, there is provided a method of facilitating electrolytically depositing a metal onto a conductive substrate from an electrolyte including an ionic form of the metal and one or more organic additives in an electrodeposition vessel by applying a current through the electrolyte from an anode to the conductive substrate to deposit the metal on the conductive substrate. The method comprises providing the anode, the anode including a core comprised of titanium, an interlayer disposed on the core and comprised of one of a titanium-tantalum alloy, titanium grade 7, titanium grade 7H, titanium grade 11, titanium grade 16, titanium grade 16H, titanium grade 17, or titanium grade 19; and a catalyst material layer comprised of one or more of platinum, iridium, iridium oxide, ruthenium, ruthenium oxide, palladium, tantalum, or tantalum oxide disposed on the interlayer.

In some embodiments, the anode is provided having the core comprised of one of titanium grade 1 or titanium grade 2.

In some embodiments, the electrolyte includes an aqueous solution including one of chromium ions, tin ions, zinc ions, or copper ions.

In some embodiments, the electrolyte includes an aqueous solution including chromium ions and is maintained under conditions in which the chromium ions exist predominantly as Cr (III).

In some embodiments, a pH of the electrolyte is maintained between below zero and 4, between 0 and 4, between 1 and 4, or between 2.5 and 3.5

In some embodiments, the anode is provided having the catalyst comprising one or more of platinum, iridium, iridium oxide, ruthenium, ruthenium oxide, palladium, tantalum, or tantalum oxide.

In some embodiments, the one or more organic additives includes one of formic acid or a sulfonic acid.

In some embodiments, providing the anode includes providing the anode with a configuration and composition configured to pass over 50 MAh per m$^2$ of anode area prior to failure of the anode.

In some embodiments, the electrolyte includes one of sulfuric acid or a sulfonic acid.

In accordance with another aspect, there is provided a method of facilitating electrolytically depositing a metal onto a substrate from an electrolyte including an ionic form of the metal and one or more organic additives in an electrodeposition vessel by applying a current through the electrolyte from an anode to a cathode in electrical contact with the electrolyte in the electrodeposition vessel. The method comprises providing the anode, the anode including a substrate comprised of a valve metal, an interlayer disposed on the substrate and comprised of a titanium-tantalum alloy, and a catalyst disposed on the interlayer.

In accordance with another aspect, a method for electrodeposition of chromium on a substrate comprises supplying an anode including a metal substrate having a catalytic layer including a mixed metal oxide of iridium and an interlayer disposed between the substrate and the catalytic layer, the interlayer including an alloy of one of titanium and tantalum or titanium and palladium.

In some embodiments, the anode is supplied having the catalytic layer being a mixed metal oxide of iridium and tantalum.

In some embodiments, the anode is supplied having the interlayer substantially free of oxides of titanium or tantalum.

In some embodiments, the anode is supplied having the metal substrate comprised of a valve metal.

In some embodiments, the anode is supplied with a configuration and composition configured to pass from about 5 to about 20 kA/m$^2$ through the anode.

In accordance with another aspect, there is provided a method of retrofitting a system for electrodeposition of chromium onto a conductive substrate from an organic-containing electrolyte. The method comprises replacing an anode of the system with an anode including a core comprising titanium, an interlayer disposed on the core and comprising a titanium-tantalum alloy, and a catalyst comprising one or more of platinum, iridium, iridium oxide, ruthenium, ruthenium oxide, tantalum, palladium, or tantalum oxide disposed on the interlayer.

BRIEF DESCRIPTION OF THE DRAWINGS

Various aspects of the at least one embodiment are discussed below with reference to the accompanying figures, which are not intended to be drawn to scale. The figures are included to provide illustration and a further understanding of the various aspects and embodiments, and are incorporated in and constitute a part of this specification, but are not intended as a definition of the limits of the disclosure. Where technical features in the figures, detailed description, or any claim are followed by reference signs, the reference signs have been included for the sole purpose of increasing the intelligibility of the figures and description. In the figures, each identical or nearly identical component that is illustrated in various figures is represented by a like numeral. For purposes of clarity, not every component may be labeled in every figure. In the figures:

DETAILED DESCRIPTION

Figure 1A:
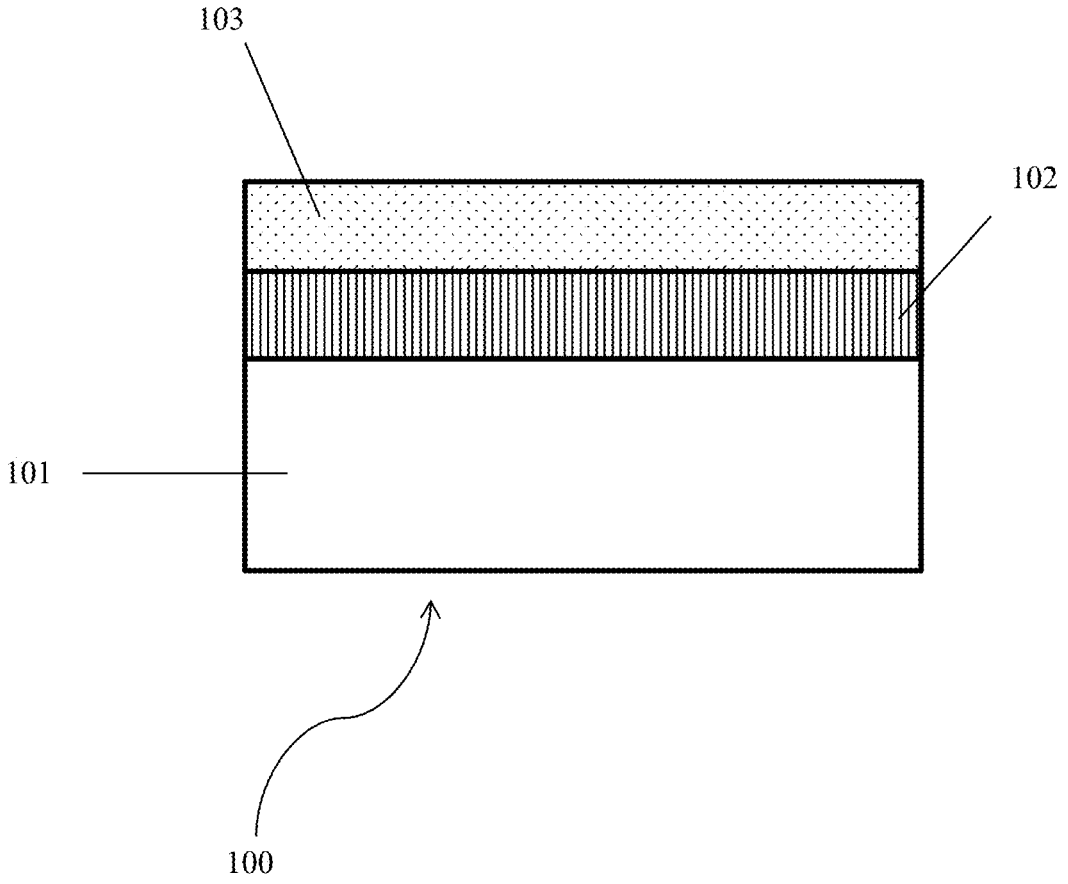
FIG. 1A is a side view of an electrode according to one embodiment of the disclosure.

An electrode is a solid electric conductor through which an electric current enters or leaves an electrolytic cell or other medium. Electrodes may be used in any electrochemical process that require an electrical conductor. For example, electrodes may be used in electro-galvanizing, electroplating, electro-tinning, electroforming, electrowinning (e.g., electrowinning of metals such as copper, nickel, and zinc), and other electrochemical processes. Electrodes may be used in any halogen-evolving processes, such as hypochlorite, chlorate, and chlor alkali production, or in chlor organic synthesis. Electrodes may also be used in electrolytic chlorination systems and processes. Electrolytic chlorination systems and processes may produce sodium hypochlorite through the electrolysis of a brine solution. For example, the OSEC® B Series on-site electrolytic chlorination systems available from Evoqua Water Technologies (Pittsburgh, PA) produce sodium hypochlorite on-demand and on-site through the electrolysis of a brine solution.

Electrodes and associated electrodeposition systems and electrolytes as disclosed herein may be utilized for the electroplating of metals such as Cr, Sn, Cu, or Zn onto a conductive substrate, for example, a steel strip.

Electrodes may be used in electrolytic cells. An electrolytic cell is an electrochemical cell that may be used to overcome a positive free energy, which indicates a non-spontaneous reaction, and force a chemical reaction in a desired direction. The electrolytic cell converts electrical energy into chemical energy or produces chemical products through a chemical reaction.

The electrode in an electrolytic cell may be referred to as either an anode or a cathode, depending on the direction of electrical current through the cell. The anode is an electrode at which electrons leave the cell and oxidation of ions within the cell occurs, and the cathode is an electrode at which electrons enter the cell and reduction of ions within the cell occurs. Under these conditions, the direction of current through the cell is from the anode to the cathode. Each electrode may become either the anode or the cathode depending on the process and the direction of current through the cell.

The design of electrolytic cells and their electrodes may depend on one or more factors. The one or more factors may include, for example, construction and operating costs, desired product, electrical, chemical, and transport properties, electrode materials, shapes and surface properties, pH of the system (for example, electrolyte pH), and temperature of the system (for example, electrolyte temperature), competing undesirable reactions, and undesirable byproducts.

Depending on the electrochemical process, one or more properties of the process, for example, one or more of current density in the electrolytic cell, pH of the system (for example, electrolyte pH), or temperature of the system (for example, electrolyte temperature) may affect the effectiveness of the system and process, for example, the service life of the electrodes. For example, exposure to one or more of a high current density, low pH, or high temperature may lower the service life of an electrode. In some embodiments, exposure to one or more of a high current density, low pH, or high temperature may cause passivation of the electrode.

Passivation is the inhibition of a dissolution reaction caused by the formation of non-dissolving films. Anode and/or cathode passivation may result in one or more of lost production capacity, increased power costs, and decreased anode and/or cathode quality. When titanium is used as the material of an anode, anode passivation is the growth of an insulating titanium dioxide layer in the coating and the core of the anode, which increases the electrical potential in the anode, and causes deactivation of the anode. In some embodiments, exposure to one or more of a high current density, low pH, or high temperature may cause wear of the electrode. Wear of the electrode, or "electrode wear" is the removal of material from the electrode. In some embodiments, exposure to one or more of a high current density, low pH, or high temperature may cause both passivation and wear of the electrode.

As noted above, the electrolytic cell may comprise an electrolyte. An electrolyte is a substance that produces an electrically conducting solution when dissolved in a polar solvent, such as water. The solution is electrically neutral. The dissolved electrolyte separates into cations and anions that are dispersed uniformly through the solute. When an electric potential, or voltage, is applied to the electrolyte solution, the cations are drawn to the electrode that has an abundance of electrons, and the anions are drawn to the electrode that has a deficit of electrons. The movement of anions and cations in opposite directions within the solution amounts to a current. An electrolyte may be referred to as strong or weak, depending on the dissociation of the solute. If a high proportion, for example, greater than 50% of the solute dissociates to form free ions, the electrolyte is strong. If a high proportion, for example, less than 50%, of the solute does not dissociate, the electrolyte is weak.

In some embodiments, electrodes may be exposed to electrolytes having a low pH. Electrolytes having a low pH may refer to electrolytes having an acidic pH, for example, less than a pH of 7. For example, the electrolytes may be strong acid electrolytes. In some aspects, the strong acid electrolyte may be or may include sulfuric acid or another acid.

In some embodiments, low pH may refer to electrolytes having a pH lower than about 4 or lower than about 3. In some embodiments, low pH may refer to electrolytes having a pH lower than about 2. In some embodiments, low pH may refer to electrolytes having a pH lower than about 1. In some embodiments, low pH may refer to a pH lower than about 0.8. In some embodiments, low pH may refer to a pH lower than about 0.6. In some embodiments, low pH may refer to a pH lower than about 0.4. In some embodiments, low pH may refer to a pH lower than about 0.2.

In some embodiments, electrodes may be exposed to electrolytes having a high temperature. A high temperature may be a temperature at which the cell voltage of the electrode undesirably decreases. A high temperature may be a temperature higher than about 50° C. In some embodiments, a high temperature is higher than about 55° C. In some embodiments, a high temperature is higher than about 60° C. In some embodiments, a high temperature is higher than about 65° C. In some embodiments, a high temperature is higher than about 70° C.

In some embodiments, electrodes may be exposed to high current densities. A current density is a measure of the density of an electric current. It is defined as a vector whose magnitude is the electric current per active area of an electrode, and may be measured in, for example, amperes per square meter ($A/m^2$). High current densities may have undesirable consequences. For example, high current densities may have undesirable consequences to one or more of a coating, electrode, electrolytic cell, and electrochemical device. Electrodes have a finite, positive resistance, causing them to dissipate power in the form of heat. The current density should be kept sufficiently low to protect the electrode from passivation or wear.

In some embodiments, a high current density is a current density that causes at least one of passivation and wear of the electrodes. In some embodiments, a high current density may be higher than about 0.5 $kA/m^2$. For example, a high current density may be higher than about 1.0 $kA/m^2$. A high current density may be higher than about 1.5 $kA/m^2$. In some embodiments, a high current density may be higher than about 2.0 $kA/m^2$. For example, a high current density may be higher than about 2.5 $kA/m^2$. In some embodiments, a high current density may be higher than about 3.0 $kA/m^2$. For example, a high current density may be higher than about 3.5 $kA/m^2$. In some embodiments, a high current density may be higher than about 4.0 $kA/m^2$. For example, a high current density may be higher than about 4.5 $kA/m^2$. In some embodiments, a high current density may be about 5.0 $kA/m^2$. In some embodiments, a high current density may be up to about 15 $kA/m^2$ or higher.

An electrode may be coated with two layers of coatings, the combination of which limit passivation and wear in particular electrochemical applications. A coating layer may refer to one application or more than one application of a coating. Through use of an electrode having two coatings, a synergistic effect may result. The synergistic effect may provide optimal (e.g., increased) performance of an electrode, as compared to the sum of the performance of an electrode having a first coating and the performance of an electrode having a second coating. For example, the implementation in which an electrode is utilized may have one or more of the following characteristics: a low pH, high electrolyte temperature, and high current density.

Titanium-based anodes used in electrolytes with various inorganic and organic constituents often suffer from accelerated corrosion of the titanium core leading to shorter-than-expected lifetime. The corrosion of the titanium core of an electrode may cause the delamination of an electrocatalytic coating disposed on the electrode core. By applying a protective layer onto the titanium core (between the titanium core and the electrocatalytic coating), the corrosion of the titanium core can be impeded and the lifetime of an anode prolonged. Titanium core electrodes with protective coatings may be utilized in any implementation where the corrosion of the titanium core is a predominant factor causing the shorter-than-expected or shorter-than-desired lifetime of an anode. A protective coating disposed between a core and a catalytic layer of an electrode is referred to herein as an "interlayer".

Electrolytes in various electrochemical applications may contain substances that can increase the corrosion of the titanium core of titanium-based anodes. These substances can be inorganic or organic. The corrosion of the titanium core may lead to premature failure of anodes. In one aspect, solutions to reduce the rate of titanium core corrosion in anodes with catalytic coatings made of precious metals and their oxides is described. These solutions are based on the modification of the surface of the titanium core with various alloys to achieve better corrosion-resistance.

Electrolytes in metal plating applications often contain various organic additives leading to premature failure of anodes. This problem had been historically solved by applying more Ir loading to the outer layer of anodes, leading to the increased price of the anodes. This strategy is costly and as a result has not been widely adopted. By protecting the titanium core of an anode against corrosion, the loading of Ir in the outer layer of the anode can be kept relatively low, making the price of anodes more attractive and extended the usable life of the anodes.

In one aspect, an embodiment comprising adding a metallic interlayer has been investigated specifically for the trivalent chromium plating ("ECL"), although anodes including such metallic interlayers may also be used in the plating of other metals, for example, tin, copper, or zinc. Trivalent chromium plating is a process for the plating (also referred to as electrodeposition herein) of a chromium/chromium oxide layer on to a metal strip, for example, a steel strip, which makes use of electrolyte solutions including trivalent chromium ("Cr (III)") instead of the more hazardous hexavalent chromium ("Cr(VI)"). One challenge in this process is preventing the unintentional oxidation of Cr (III) to Cr (VI) in the electrolyte solution at the anode. In some embodiments, the electrolyte solution used for electrodeposition of Cr onto a conductive cathode includes a Cr (III) compound and a chelating agent and the anode includes a catalytic surface coating formed of one or more of platinum, iridium, iridium oxide, ruthenium, ruthenium oxide, palladium, tantalum, or tantalum oxide for reducing or eliminating the oxidation of Cr (III) ions to Cr (VI) ions.

The chelating agent may be an organic compound. The chelating agent may be a carboxylate and may include formic acid or one of its salts, for example, sodium formate (HCOONa) or another formate. The chelating agent may destabilize the Cr-containing hexa-aqua complex in accordance with the following formula, where $A^-$ represents the chelating agent ligand:

$$Cr(H_2O)_6^{3+}+A \leftrightarrow [Cr(H_2O)_5A]^{2+}+H_2O \quad (1)$$

Further, the electrolyte may be maintained at an acidic pH, for example, between less than zero and 4, between 0 and 4, between 1 and 4, between 2 and 3.5, between 2.5 and 3.5, between 2.5 and 3, or between 2.8 and 3. The acidic pH may be maintained by the inclusion of an acid, for example, sulfuric acid in the electrolyte. In processes for plating other metals, for example, tin, sulfonic acid (e.g., methanesulfonic acid) may be used. The electrolyte may further include a conductivity enhancing salt, for example, an alkali metal sulphate such as sodium sulphate ($Na_2SO_4$) or potassium sulphate ($K_2SO_4$). The sodium formate and alkali metal sulphate may be present at concentrations of about 1M, although aspects and embodiments disclosed herein are not limited to these concentrations. Further, the electrolyte may become acidic even in the absence of the addition of acid due to reactions at the anode during operation in accordance with the following formula:

$$2H_2O \rightarrow 4H^+ + O_2(g) + 4e^- \quad (2)$$

The acidic electrolyte may suppress the oxidation of Cr (III) to Cr (VI) in accordance with the following reaction:

$$Cr^{3+} + 4H_2O \leftrightarrow HCrO_4^- + 7H^+ + 3e^- \quad (3)$$

The Cr may be added to the electrolyte in the form of a trivalent chromium salt, for example, chromium (III) sulphate, chromium (III) formate, chromium (III) oxalate, chromium (III) acetate, chromium (III) potassium oxalate, and/or chromium (III) nitrate.

One drawback of the Cr (III) electrodeposition process is the reduced life of the anode. An improved anode is desired to increase acceptance of the process.

In addition, there are other applications that would benefit from using a metallic interlayer for improved corrosion resistance. These applications include (but are not limited to):

Zinc, tin, or copper plating of steel strip
General metal finishing, e.g., decorative plating of steel
Metal electrowinning
(Organic) electrosynthesis
Cu foil production
Cu PCB production The anode may include a substrate or core formed of titanium, optionally titanium grade 1 or titanium grade 2. The core may be coated with a material that helps prevent corrosion of the core, for example, a Ta/Ti layer in which the Ti or the Ta is present in a concentration of 40-60 wt %. Additionally or alternatively the electrode core may be coated with a palladium-containing Ti alloy, for example, Ti grade 7 or Ti grade 11. Other Ti grades that may be utilized include Ti grades 7H, 16, 16H, 17, or 19. This material layer may be referred to herein as an interlayer that is, in turn, coated by a second material layer that acts as a catalytic surface coating that breaks compounds such as $HCrO_4^-$ into $Cr^{3+}$ and water in accordance with equation (3) above. As disclosed above the catalytic surface coating may be or may include any one or more of platinum, iridium, iridium oxide, ruthenium, ruthenium oxide, palladium, tantalum, or tantalum oxide. In some embodiments, the catalytic coating layer comprises or consists of a mixed metal oxide of iridium and tantalum. The metal component of the catalytic coating layer may include 15-35 wt % Ta and 65-90% Ir.

Electrodes including the interlayer and catalytic coating disclosed herein, in combination, exhibit high catalytic activity, stability, longer life, better performance, less down time in operation due to less frequent replacement of the electrodes, and cost effectiveness. The Ta/Ti (or titanium grade 7, titanium grade 7H, titanium grade 11, titanium grade 16, titanium grade 16H, titanium grade 17, or titanium grade 19) interlayer may cause the anode to exhibit a longer lifetime than another anode formed of the same materials but using $Ta_2O_5$ as the interlayer.

The interlayer may be applied directly to the electrode core, and the catalytic coating layer may be applied directly to the interlayer. The interlayer and catalytic coating layer may reduce at least one of passivation, corrosion, delamination, or wear of the electrode. In some embodiments, the interlayer may reduce passivation of the electrode. In some embodiments, the catalytic coating layer may reduce wear of the electrode.

As used herein, a "two coating layer electrode" refers to an electrode that is coated on at least one of its surfaces with a first coating comprising a mixture to provide a first coating layer, and a second coating that at least partially coats the first coating to provide a second coating layer. The first coating layer is referred to herein as the interlayer and the second coating layer is referred to herein as the catalytic coating layer. More than one application of the material(s) of the interlayer may be performed to achieve the desired material loading. More than one application of the material(s) of the catalytic coating layer may be performed to achieve the desired material loading. At least one of the interlayer or catalytic coating layer may be a mixture that reduces at least one of passivation and wear of the electrode. In some embodiments, the interlayer may reduce passivation of the electrode. In some embodiments, the catalytic coating layer may reduce wear of the electrode. In some embodiments, the surface of the electrode core may be at least partially covered with an interlayer comprising a mixture. The interlayer may include a mixture or alloy comprising titanium and tantalum or a mixture or alloy of titanium and palladium. In some embodiments, the interlayer may be a mixture or alloy consisting of or consisting essentially of titanium and tantalum or a mixture or alloy of titanium and palladium. The interlayer may be at least partially covered by a catalytic coating layer comprising a mixture. In some embodiments, the catalytic coating layer may be a mixture comprising iridium oxide and tantalum oxide. In some embodiments, the catalytic coating layer may be a mixture consisting of or consisting essentially of iridium oxide and tantalum oxide.

In some embodiments, the electrode may comprise an electrically conductive substrate or core, an interlayer covering at least a portion of a surface of the electrically conductive core, comprising, consisting of, or consisting essentially of a mixture or alloy of titanium and tantalum or a mixture or alloy of titanium and palladium, and a catalytic coating layer covering at least a portion of the interlayer, comprising a mixture of iridium oxide and tantalum oxide. In some embodiments, the electrode may consist essentially of an electrically conductive core, an interlayer covering at least a portion of a surface of the electrically conductive core, comprising a mixture or alloy of titanium and tantalum or a mixture or alloy of titanium and palladium, and a catalytic coating layer covering at least a portion of the interlayer, comprising a mixture of iridium oxide and tantalum oxide. In some embodiments, the electrode may consist of an electrically conductive core, an interlayer covering at least a portion of a surface of the electrically conductive substrate, comprising a mixture or alloy of titanium and tantalum or a mixture or alloy of titanium and palladium, and a catalytic coating layer covering at least a portion of the interlayer, comprising a mixture of iridium oxide and tantalum oxide.

The electrode substrate or core may be any core having electrically conductive properties. The electrode core may be any substrate having sufficient mechanical strength to serve as a support for the interlayer and catalytic coating layer. The electrode core may be any substrate having a resistance to corrosion when exposed to the interior environment of an electrolytic cell. The electrode core may be a metal. In some embodiments, the electrode core may be a valve metal or an alloy thereof. Valve metals are any of the transition metals of Group IV and V of the periodic table, including titanium, vanadium, zirconium, niobium, hafnium, and tantalum. In some embodiments, suitable valve metals include titanium, zirconium, niobium, and tantalum. In some embodiments, the electrode core preferably comprises, consists of, or consists essentially of titanium. Titanium may be preferred because of its availability, chemical properties, and low cost. The titanium core may be an alloy of titanium including trace amounts of another metal, for example, palladium and may be grade 1 or grade 2 titanium.

The interlayer may comprise a mixture or alloy of titanium and tantalum or a mixture or alloy of titanium and palladium. In some embodiments, the interlayer may consist essentially of a mixture of titanium and tantalum or a mixture or alloy of titanium and palladium. In some embodiments, the interlayer may consist of a mixture or alloy of titanium and tantalum or a mixture or alloy of titanium and palladium. Tantalum in the interlayer may be in any weight concentration such that a desired property is achieved, for example, reduction of passivation or wear of the electrode, or increased lifetime of the interlayer. The weight concentration of tantalum is the weight of tantalum compared to the total weight of the interlayer. In some embodiments, the weight concentration of tantalum in a Ti/Ta interlayer is within a range of 40 wt. % to 60 wt. %. In some embodiments, the interlayer can have a portion thereof as an oxide of titanium or tantalum or a mixed metal oxide of titanium and tantalum. The oxide may make up as much as 5-10 wt. % of the interlayer. The interlayer may include a gradient of the oxide with the highest concentration of oxide being present on the outer surface of the interlayer and the concentration of oxide decreasing with distance into the interlayer.

The catalytic coating layer may comprise a mixture of iridium oxide ($IrO_2$) and tantalum oxide ($Ta_2O_5$). In some embodiments, the catalytic coating layer may consist essentially of a mixture of $IrO_2$ and $Ta_2O_5$. In some embodiments, the catalytic coating layer may consist of iridium oxide $IrO_2$ and $Ta_2O_5$. Iridium oxide may be in any weight concentration such that a desired property is achieved, for example, reduction of passivation or wear of the electrode. The weight concentration of iridium oxide is the weight of iridium oxide compared to the total weight of the catalytic coating layer. In some embodiments, the weight concentration of iridium oxide is within a range of 40 wt. % to 90 wt. % or from 65 wt. % to 90 wt. %. In some embodiments, the weight concentration of iridium oxide in the catalytic coating layer is about 65 wt. %.

The electrode core may be, for example, coated with the interlayer and catalytic coating layer according to any application process that may provide for a homogeneous or substantially homogeneous dispersal of material to the desired surface. For example, the interlayer may be applied to the electrode substrate by physical vapor deposition (e.g., magnetron sputtering) or chemical vapor deposition. The catalytic coating layer may be applied to the interlayer by brushing, rolling, dipping, spraying, sputtering, evaporation, or by atomic or molecular layer deposition, or the like. The interlayer may be coated with the catalytic coating layer according to a thermal oxidation method.

Magnetron sputtering is a physical vapor deposition (PVD) technique used for the deposition of thin films onto a substrate. The technique involves the use of a magnetron cathode and an inert gas, typically argon, which is ionized to create a plasma. The plasma then sputters material from the target, which is deposited as a thin film on the substrate.

To prepare the electrode, an alloy of titanium and tantalum would need to be deposited onto the titanium core using magnetron sputtering. The specific equipment and operating parameters required for this process may depend on the desired properties of the alloy, such as its composition, thickness, and adhesion to the substrate.

Some general guidelines for selecting magnetron sputtering equipment and operating parameters include:

Magnetron sputtering equipment: High-quality magnetron sputtering equipment is necessary for consistent and reliable deposition of the alloy. The equipment should be capable of maintaining a high vacuum and providing precise control of the deposition process parameters.

Target material: The target material should be a high-purity alloy of titanium and tantalum with the desired composition and uniformity.

Operating parameters: The operating parameters that affect the deposition process include the power input, gas flow rate, pressure, and substrate temperature. The specific parameters used will depend on the properties desired for the deposited alloy.

Substrate preparation: The substrate, in this case, the titanium core (e.g., a grade 1 titanium core), should be cleaned and prepared before deposition to ensure good adhesion and uniformity of the deposited film.

The appropriate inert gas atmosphere, ranges of vacuum pressure, and substrate temperature for magnetron sputtering of titanium and tantalum may vary depending on several factors such as the specific equipment used, the desired properties of the deposited film, and the process requirements of the application.

Inert gas atmosphere: Argon is the most commonly used inert gas for magnetron sputtering of metals and alloys, including titanium and tantalum. The argon gas is used to create a plasma that sputters the target material and deposits it onto the substrate. The purity of the argon gas used should be high to ensure a clean deposition process.

Vacuum pressure: The vacuum pressure during magnetron sputtering is typically in the range of $10^{-2}$ to $10^{-6}$ Torr. The actual pressure used will depend on factors such as the size of the chamber, the desired deposition rate, and the specific target material. The vacuum pressure must be maintained throughout the deposition process to prevent contamination and ensure a high-quality film.

Substrate temperature: The substrate temperature during magnetron sputtering of titanium and tantalum is typically in the range of 100° C. to 500° C. The actual temperature used will depend on the specific application and the properties desired for the deposited film. Higher substrate temperatures can improve adhesion and film density, but may also increase the risk of thermal damage to the substrate.

There are several suppliers of magnetron sputtering equipment, some of which are, e.g., AJA International, Buhler Leybold Optics, Kurt J. Lesker Company, Semicore Equipment Inc., Plasma Quest Ltd., and Denton Vacuum.

The electrode core may first be prepared for application of the interlayer. For example, the electrode core may be treated or cleaned to accept the interlayer and catalytic coating layer, or to provide for a surface that may be susceptible to adherence of the interlayer. Cleaning of the electrode core may be performed by chemical degreasing, electrolytic degreasing, or treatment with an oxidizing acid. The electrode core may be prepared by any method suitable to remove or minimize contaminants and develop high surface roughness that may facilitate proper adhesion of the interlayer to the surface of the core and lower the effective current density for coated metal surfaces, thus also decreasing the electrode operating potential. Longer lived anodes translate into less down time and cell maintenance, thereby cutting operating cost. For example, the electrode core may be prepared by a cleaning, sandblasting, etching, and/or pre-oxidation process. Other methods of preparing the electrode core may include plasma spraying, melt spraying with ceramic oxide particles, melt spraying of a valve metal layer onto the electrode substrate, grit blasting with a sharp grit, and annealing. Cleaning of the electrode core may be followed by mechanical roughening to prepare the surface for deposition of the interlayer. In some embodiments, when the cleaning is performed via sandblasting, it may be followed by an etching process. In some embodiments, the mechanical roughening process may be flame spray application of a fine-particle mixture of metal powders.

In some embodiments, a porous oxide layer may be applied to the electrode core to anchor the interlayer to the core. For example, the oxide layer may be flame or plasma sprayed onto an electrode core before application of an electrochemically active substance. In some embodiments, the thermally sprayed material may consist of a metal oxide or a metal nitride to which electrocatalytically active particles have been pre-applied.

The catalytic coating layer may be applied by way of a thermal oxidation method in which the components of the catalytic coating layer are provided in a molar ratio suitable to provide a desired property or effect to the resulting electrode. For example, the desired effect or property may be extended service life by way of one or both of the reduction of wear and the avoidance of passivation.

The catalytic coating layer may be dried in a furnace at a first temperature and for a first duration, and subsequently dried in a first or second furnace at a second temperature and for a second duration. One or both of the first temperature and the second temperature may be an elevated temperature. In some embodiments, the catalytic coating layer may be dried in a first furnace at a temperature between about 80° C. and about 120° C. For example, the catalytic coating layer may be dried in a first furnace at about 90° C. In some embodiments, the catalytic coating layer may be dried in a first furnace for about 5 minutes to about 3 hours. For example, the catalytic coating layer may be dried in a first furnace for about 5 minutes to about 60 minutes. In some embodiments, the catalytic coating layer may be dried in a first furnace for about 10 minutes.

The catalytic coating layer may then be dried in a second furnace. The second furnace may contain a source of oxygen. For example, the source of oxygen may be air. In some embodiments, the catalytic coating layer may be dried in a second furnace at a temperature between about 250° C. and about 750° C. For example, the catalytic coating layer may be dried in a second furnace at about 500° C. In some embodiments, the catalytic coating layer may be dried in a first furnace for about 5 minutes to about 3 hours. For example, the catalytic coating layer may be dried in a second furnace for about 1 hour. More than one application of the materials of the catalytic coating layer may be applied to achieve a desired material loading.

In some embodiments, the interlayer and/or catalytic coating layer may have a metal loading of from about 0.2 $g/m^2$ to about 3.5 $g/m^2$. The thickness of the interlayer and/or catalytic coating layer may be independent of the dimensions of the electrode.

The electrode may be installed in an electrolytic cell. In an embodiment, the electrolytic cell also has a power source for supplying a current to the electrodes of the electrolytic cell. In some embodiments, the source of current may be a direct current source. In the current direction, one electrode typically acts as the anode and its counterpart typically acts as the cathode.

The electrolytic cell may be part of a system. For example, the electrolytic cell may be used in a wastewater treatment system. In some embodiments, the electrolytic cell may be used in a municipal or industrial wastewater treatment system. In some embodiments, the electrolytic cell may be used in a chemical processing system. In some embodiments, the electrolytic cell may be used in an industrial process water system. For example, the electrolytic cell may be used in an electrolytic chlorine generation system. The system may comprise a source of salt water. For example, the system may comprise a source of ballast water. In some embodiments, the system may further comprise a water outlet. For example, the system may comprise a potable water outlet. In some embodiments, the system may further comprise a water storage unit fluidly connected to the water outlet. In some embodiments, the system may further comprise a contaminant outlet. For example, the system may comprise a chlorine solution outlet. In some embodiments, the chlorine solution outlet may comprise a sodium hypochlorite solution outlet. In some embodiments, the system may comprise a contaminant storage unit fluidly connected to the contaminant outlet.

Figure 1B:
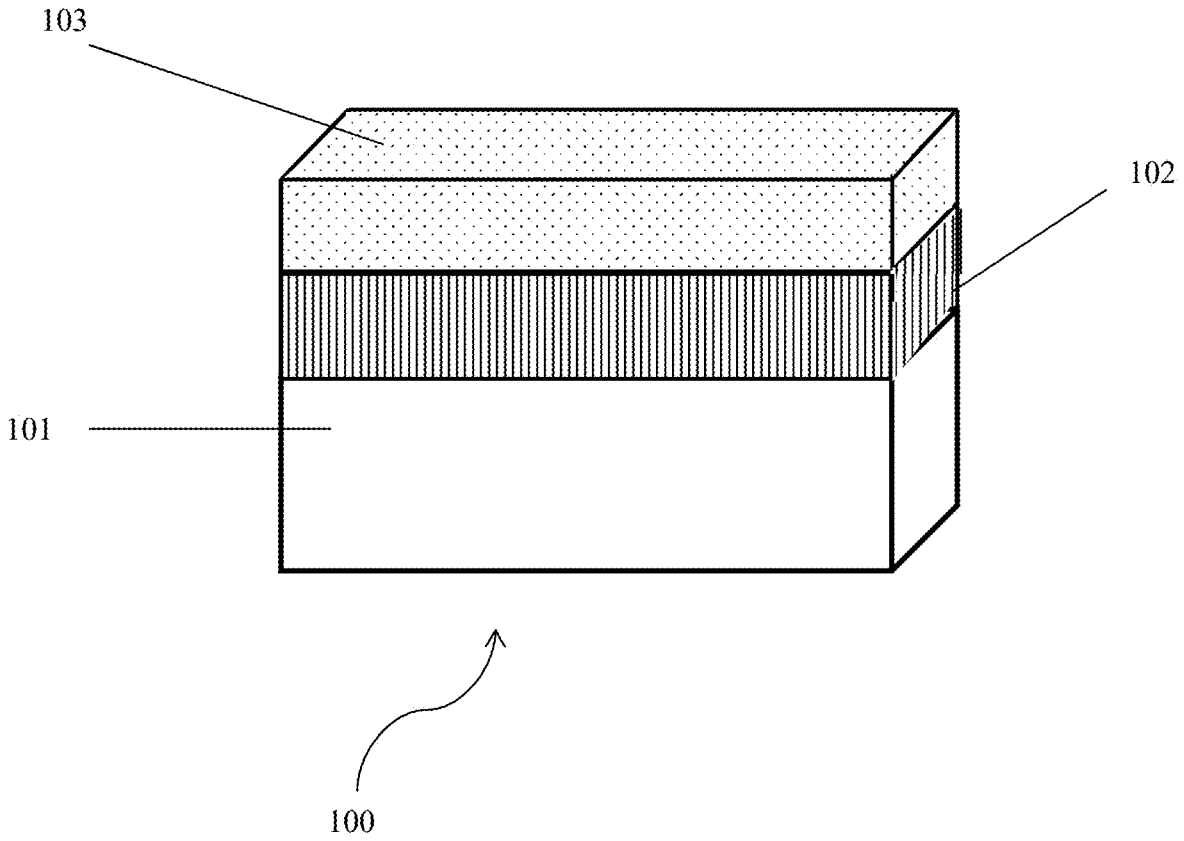
FIG. 1B is a perspective view of an electrode according to one embodiment of the disclosure.

FIGS. 1A and 1B illustrate a portion of an electrode in accordance with the present disclosure. Electrode 100 comprises substrate or core 101. Core 101 may be any substrate having electrically conductive properties. Core 101 may be a metal. In some embodiments, core 101 may be a valve metal. For example, core 101 may comprise titanium, vanadium, zirconium, niobium, hafnium, or tantalum. In some embodiments, core 101 preferably comprises, consists of, or consists essentially of titanium in a pure form or as an alloy, for example, grade 1 or grade 2 titanium. Core 101 may be prepared for application of an interlayer. For example, core 101 may be treated or cleaned to accept the interlayer, or to provide for a surface that may be susceptible to adherence of an interlayer. Cleaning of core 101 may be performed by chemical degreasing, electrolytic degreasing, or treatment with an oxidizing acid. Core 101 may be prepared by any method suitable to remove or minimize contaminants and develop high surface roughness that may facilitate proper adhesion of the interlayer to the surface of core 101 and lower the effective current density for coated metal surfaces, thus also decreasing the electrode operating potential. For example, core 101 may be prepared by a cleaning, sandblasting, etching, and/or pre-oxidation process. Other methods of preparing core 101 may include plasma spraying, melt spraying with ceramic oxide particles, melt spraying of a valve metal layer onto the electrode core, grit blasting with a sharp grit, and annealing. Cleaning of core 101 may be followed by mechanical roughening to prepare the surface for deposition of the interlayer. In some embodiments, when the cleaning is performed via sandblasting, it may be followed by an etching process. In some embodiments, the mechanical roughening process may be flame spray application of a fine-particle mixture of metal powders.

Core 101 may be coated with an interlayer 102. Interlayer 102 may cover at least a portion of the surface of core 101. The interlayer 102 may comprise a mixture or alloy of titanium and tantalum or a mixture or alloy of titanium and palladium (e.g., grade 7 or grade 11 titanium). The interlayer 102 may comprise titanium or tantalum in any weight concentration such that a desired property is achieved, for example, at least one of reduction of passivation or wear of the electrode. In some embodiments, the weight concentration of titanium or tantalum in the interlayer 102 is within a range of 40 wt. % to 60 wt. %. In some aspects, the weight concentration of titanium or tantalum in the interlayer 102 is within a range of 45 wt. % to 55 wt. %. The interlayer 102 may be applied to the surface of core 101 by any known application process. For example, the interlayer 102 may be applied to the surface of core 101 by physical vapor deposition (evaporation or sputtering) or chemical vapor deposition. The interlayer 102 is illustrated in FIGS. 1A and 1B on only one side of the core 101, however, it is to be appreciated that the interlayer 102, as well as the catalytic coating layer 103, may be disposed on both sides or on all surfaces of the core 101.

The interlayer 102 may be coated with a catalytic coating layer 103. The catalytic coating layer 103 may cover at least a portion of the interlayer 102. The catalytic coating layer 103 may comprise a mixture of iridium oxide ($IrO_2$) and tantalum oxide ($Ta_2O_5$). The catalytic coating layer 103 may comprise $IrO_2$ in any weight concentration such that a desired property is achieved, for example, reduction of passivation or wear of the electrode. In some embodiments, the weight concentration of $IrO_2$ in the catalytic coating layer 103 is within a range of from 40 wt. % to 90 wt. % or from 65 wt. % to 90 wt. %. In some embodiments, the weight concentration of $IrO_2$ in the catalytic coating layer 103 is about 65 wt. %. The catalytic coating layer 103 may include between 3 g/m$^2$ and 70 g/m$^2$ of Ir. The catalytic coating layer 103 may be applied to first coating layer 102 by brushing, rolling, or spraying. The catalytic coating layer 103 may be applied to the interlayer 102 according to a thermal oxidation method.

Figure 2:
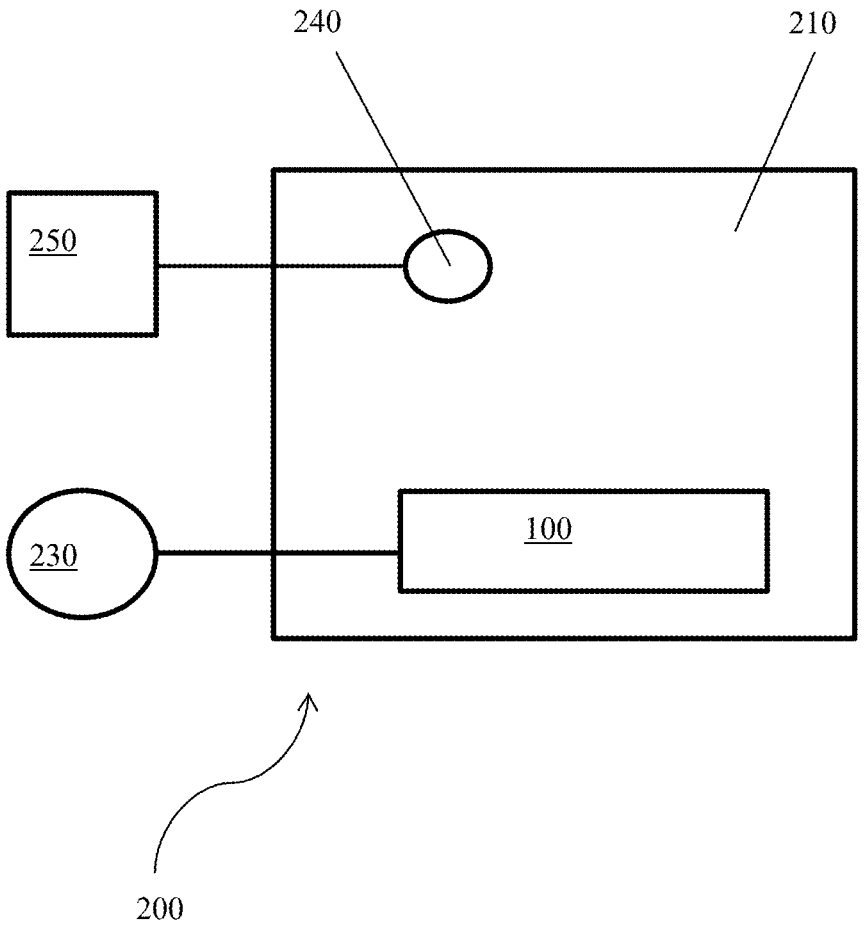
FIG. 2 is a schematic of an electrochemical device according to one embodiment of the disclosure.

Referring now to FIG. 2, an electrochemical system is provided. System 200 may comprise electrolytic cell 210. Electrolytic cell 210 may comprise at least one electrode 100 as described above. Electrode 100 may be at least one of an anode and a cathode. In some embodiments, electrode 100 is an anode. System 200 may further comprise power source 230 operably connected to electrolytic cell 210. Power source 230 may supply direct current to electrolytic cell 210. The power source 230 may supply, for example, between 5 kA/m$^2$ and 20 kA/m$^2$ to the electrode 100 where the m$^2$ refers to the active area of the surface of the electrode 100. The power source 230 may supply, for example, a total electric charge of over 50 MAh per m$^2$ of anode area without delamination or corrosion of the anode.

One or more sensors 240 may be located within electrolytic cell 210. Sensor 240 may be configured to measure a quality of system 200. In some embodiments, sensor 240 may be configured to measure one or more of the pH of the system (for example, pH of an electrolyte), the temperature of the system (for example, temperature of the electrolyte), conductivity of the electrolyte, and/or the current passing through the electrodes and electrolyte. The sensor(s) 240 may communicate, electrically or otherwise, with controller 250 to provide the controller with a signal indicative of the measured property of the system. Controller 250 may control one or more properties of the system. For example, controller 250 may control the amperage into the system from power source 230.

Electrodes as described herein may be utilized as anodes in electrodeposition apparatus for depositing metals onto conductive substrates with the conductive substrate acting as the cathode of the electrodeposition apparatus.

One example of a method for electrolytically depositing chromium onto a metal substrate may include providing an electrodeposition apparatus including a vessel, an anode disposed within the vessel, and the metal substrate disposed within the vessel. The anode includes a core formed of a valve metal, an interlayer disposed on the core and consisting of, consisting essentially of, or comprising a titanium-tantalum alloy (optionally with a partially oxidized outer region), and a catalyst disposed on the interlayer. An electrolyte including an ionic form of chromium and one or more organic additives is introduced into the electrodeposition vessel. A current is applied through the electrolyte from the anode to the metal substrate to deposit the chromium on the metal substrate.

The anode may include a core formed of titanium and a catalyst layer formed of a mixed metal oxide of iridium and tantalum. The catalyst layer may include from 3 g/m$^2$ to 70 g/m$^2$, for example, 10 g/m$^2$ of iridium. The catalyst layer may include iridium and tantalum in a mass ratio of from 9:1 to 2:1. The catalyst layer is not limited to being a mixed metal oxide of iridium and tantalum but may be formed of one or more of platinum, iridium, iridium oxide, ruthenium, ruthenium oxide, palladium, tantalum, or tantalum oxide.

The interlayer may be formed of titanium and tantalum in a weight ratio of from 30:70 to 70:30. The interlayer may alternatively or additionally be formed of a palladium-containing alloy of titanium, for example, titanium grade 7, titanium grade 7H, titanium grade 11, titanium grade 16, titanium grade 16H, titanium grade 17, or titanium grade 19. An outer surface of the interlayer or interface between the interlayer and the catalytic material layer may be at least partially oxidized.

The electrolyte may include formic acid and/or a sulfonic acid (e.g., methanesulfonic acid) as one of the one or more organic additives. The electrolyte may be maintained at a pH of between less than zero and 4, between 0 and 4, between 1 and 4, or between 2.5 and 3.5.

The current may be applied at from 5 to 20 kA per m$^2$ of anode area.

The method may involve applying a greater amount of electric charge, in MAh per m$^2$ of anode area, without delamination or corrosion of the anode than in an electrodeposition apparatus including an anode having either no interlayer or an interlayer formed of tantalum oxide or titanium oxide. Over 50 MAh per m$^2$ of anode area may be passed through the anode without delamination or corrosion of the anode.

Another method that may be performed in accordance with the present disclosure is a method of electrolytically depositing a metal onto a metal substrate. The method may include providing an electrodeposition apparatus including a vessel, an anode disposed within the vessel, and the metal substrate disposed within the vessel. The anode includes a core comprised of, consisting of, or consisting essentially of titanium, an interlayer disposed on the core and comprised of, consisting of, or consisting essentially of a titanium-tantalum alloy or a pallium-containing titanium alloy, and a catalyst material layer comprised of, consisting of, or consisting essentially of one or more of platinum, iridium, iridium oxide, ruthenium, ruthenium oxide, palladium, tantalum, or tantalum oxide disposed on the interlayer. An electrolyte including an ionic form of the metal and one or more organic additives may be introduced into the electrodeposition vessel. A current may be passed through the electrolyte from the anode to the metal substrate to deposit the metal on the metal substrate.

The anode may have a core comprised of, consisting of, or consisting essentially of one of titanium grade 1 or titanium grade 2.

Introducing the electrolyte into the electrodeposition vessel may include introducing an aqueous solution including one of chromium ions, tin ions, copper ions, or zinc ions into the electrodeposition vessel.

Introducing the electrolyte into the electrodeposition vessel may include introducing an aqueous solution including chromium ions and the method may further include maintaining the electrolyte under conditions in which the chromium ions exist predominantly as Cr (III).

The pH of the electrolyte may be maintained between below zero and 4, between 0 and 4, between 1 and 4, or between 2.5 and 3.5.

The catalyst material layer disposed on the interlayer of the anode may comprise of, consist of, or consist essentially of one or more of platinum, iridium, iridium oxide, ruthenium, ruthenium oxide, palladium, tantalum, or tantalum oxide.

Formic acid or sulfonic acid (e.g., methanesulfonic acid) may be introduced into the electrolyte as one of the one or more organic additives.

A total electric charge of over 50 MAh per $m^2$ of anode area may be passed through the anode without delamination or corrosion of the anode.

Introducing the electrolyte into the electrodeposition vessel may include introducing sulfuric acid into the electrodeposition vessel.

Another method of electrolytically depositing a metal onto a substrate disclosed herein may include introducing an electrolyte including an ionic form of the metal and one or more organic additives into an electrodeposition vessel and applying a current through the electrolyte from an anode to a cathode in electrical contact with the electrolyte in the electrodeposition vessel. The anode may include a substrate comprised of, consisting of, or consisting essentially of a valve metal, an interlayer disposed on the substrate and comprised of, consisting of, or consisting essentially of a titanium-tantalum alloy, and a catalyst material layer disposed on the interlayer.

In a method for electrodeposition of chromium on a substrate, an anode may be supplied in which the anode includes a metal substrate having a catalytic layer including a mixed metal oxide of iridium and an interlayer disposed between the substrate and catalytic layer. The interlayer may include an alloy of titanium and tantalum or an alloy of titanium and palladium, for example, grade 7 or grade 11 titanium.

The catalytic layer may be a mixed metal oxide of iridium and tantalum.

The interlayer may be substantially free of oxides of titanium or tantalum or may include a partially oxidized outer surface region.

The metal substrate may be comprised of a valve metal.

The apparatus for electrodeposition may include an electrical power supply for applying about 10 to about 20 kA/$m^2$ through the anode.

Another method of facilitating electrolytically depositing chromium onto a metal substrate from an electrolyte including an ionic form of chromium and one or more organic additives in an electrodeposition vessel in by applying a current through the electrolyte from an anode to the metal substrate to deposit the chromium on the metal substrate in accordance with the present disclosure includes providing the anode. The anode includes a core comprising, consisting of, or consisting essentially of a valve metal, an interlayer disposed on the core and comprising, consisting of, or consisting essentially of one of a titanium-tantalum alloy or a titanium-palladium alloy, and a catalyst material layer disposed on the interlayer.

The anode may be provided having the core comprising, consisting of, or consisting essentially of titanium and having the catalyst material layer comprising, consisting of, or consisting essentially of a mixed metal oxide of iridium and tantalum.

The catalyst material layer may alternatively be formed of one or more of platinum, iridium, iridium oxide, ruthenium, ruthenium oxide, palladium, tantalum, or tantalum oxide.

The catalyst material layer may be formed with between 3 g/$m^2$ and 70 g/$m^2$ of iridium, for example, with about 10 g/$m^2$ of iridium.

The anode may be provided having the interlayer formed of titanium and tantalum in a weight ratio of from 30:70 to 70:30 and/or having the catalyst material layer formed of iridium and tantalum in a mass ratio of from 9:1 to 2:1.

The electrolyte may have a pH of between 1 and 4. The one or more organic additives in the electrolyte may include one of formic acid or a sulfonic acid.

Providing the anode may include providing the anode with a configuration and composition configured to pass a greater amount of electric charge, in MAh per $m^2$ of anode area, without failure of the anode than an anode having either no interlayer or an interlayer formed of tantalum oxide, for example, over 50 MAh per $m^2$ of anode area prior to failure of the anode.

Another method of facilitating electrolytically depositing a metal onto a conductive substrate from an electrolyte including an ionic form of the metal and one or more organic additives in an electrodeposition vessel by applying a current through the electrolyte from an anode to the conductive substrate to deposit the metal on the conductive substrate according to the present disclosure includes providing the anode. The anode includes a core formed of titanium, an interlayer disposed on the core and consisting of, consisting essentially of, or comprising one of a titanium-tantalum alloy, titanium grade 7, titanium grade 7H, titanium grade 11, titanium grade 16, titanium grade 16H, titanium grade 17, or titanium grade 19; and a catalyst material layer formed of one or more of platinum, iridium, iridium oxide, ruthenium, ruthenium oxide, palladium, tantalum, or tantalum oxide disposed on the interlayer.

The anode may be provided having the core formed of one of titanium grade 1 or titanium grade 2.

The electrolyte may include an aqueous solution including one of chromium ions, tin ions, zinc ions, or copper ions.

The electrolyte may include an aqueous solution including chromium ions and may be maintained under conditions in which the chromium ions exist predominantly as Cr (III). For example, the pH of the electrolyte may be maintained between 1 and 4. The one or more organic additives may include one of formic acid, sulfuric acid, or a sulfonic acid.

The anode may be provided having the catalyst material layer formed of one or more of platinum, iridium, iridium oxide, ruthenium, ruthenium oxide, palladium, tantalum, or tantalum oxide.

The anode may be provided with a configuration and composition configured to pass over 50 MAh per $m^2$ of anode area prior to failure of the anode.

Another method of facilitating electrolytically depositing a metal onto a substrate from an electrolyte including an ionic form of the metal and one or more organic additives in an electrodeposition vessel by applying a current through the electrolyte from an anode to a cathode in electrical contact with the electrolyte in the electrodeposition vessel may include providing the anode. The anode may include a substrate formed of a valve metal, an interlayer disposed on the substrate and formed of a titanium-tantalum alloy, and a catalyst disposed on the interlayer.

In a method for electrodeposition of chromium on a substrate in accordance with the present disclosure, one may supply an anode including a metal substrate having a catalytic layer including a mixed metal oxide of iridium and an interlayer disposed between the substrate and the catalytic layer. The interlayer may include an alloy of one of titanium and tantalum or titanium and palladium. The catalytic layer may be a mixed metal oxide of iridium and tantalum. The interlayer may be substantially free of oxides of titanium or tantalum except, optionally, in an outer surface region thereof. The metal substrate may be comprised of a valve metal.

The anode may be supplied with a configuration and composition configured to pass from about 5 to about 20 $kA/m^2$ through the anode.

A method of retrofitting a system for electrodeposition of Cr (III) onto a conductive substrate from an organic-containing electrolyte in accordance with the present disclosure may include replacing an anode of the system with an anode including a core comprised of, consisting of, or consisting essentially of titanium, an interlayer disposed on the core and comprised of, consisting of, or consisting essentially of a titanium-tantalum alloy, and a catalyst comprised of, consisting of, or consisting essentially of one or more of platinum, iridium, iridium oxide, ruthenium, ruthenium oxide, tantalum, palladium, or tantalum oxide disposed on the interlayer.

The function and advantages of these and other embodiments will be more fully understood from the following non-limiting example. The example is intended to be illustrative in nature and are not to be considered as limiting the scope of the embodiments discussed herein.

Example

A titanium electrode core (grade 1) was etched in hydrochloric acid (6.5 mol $L^{-1}$, 90° C., 90 minutes) and was coated with Ti/Ta metallic interlayer (Ti 55-60 wt. %) using DC magnetron sputtering with a Full-E FE-2400 sputter device. The sputtering was carried out at $5\text{-}10^{-3}$ Pa, 200° C. Afterwards, the core and interlayer were annealed for 1 hour at 540° C. Finally, the interlayer was coated using a spin coater with butanol solution containing Ir ($H_2IrCl_6$) and Ta (tantalum ethoxide $Ta_2(OC_2H_5)_{10}$) until the loading of Ir reached 10 g $m^{-2}$. The mass ratio between Ir and Ta in the butanol solution was varied between 9:1 to 2:1.

A similar electrode was prepared but using a $Ta_2O_5$ interlayer instead of the Ti/Ta metallic interlayer.

Both the electrodes were placed in an aqueous electrolyte solution including 1 M $Na_2SO_4$+1 M HCOONa at 43° C. A current density of 15 A per $m^2$ of each electrode was passed through each electrode with each electrode acting as an anode. The electrode with the Ti/Ta interlayer exhibited a lifetime of 60 $MAh/m^2$ prior to failure while the electrode with the $Ta_2O_5$ interlayer failed after 25 $MAh/m^2$. The time of failure was defined as the time at which the initial voltage applied across the electrodes doubled.

The electrode with the Ti/Ta interlayer thus exhibited a lifetime of more than twice that of the electrode with the $Ta_2O_5$ interlayer.

Having now described some illustrative embodiments of the disclosure, it should be apparent to those skilled in the art that the foregoing is merely illustrative and not limiting, having been presented by way of example only. Numerous modifications and other embodiments are within the scope of one of ordinary skill in the art and are contemplated as falling within the scope of the disclosure. In particular, although many of the examples presented herein involve specific combinations of method acts or system elements, it should be understood that those acts and those elements may be combined in other ways to accomplish the same objectives.

Those skilled in the art should appreciate that the parameters and configurations described herein are exemplary and that actual parameters and/or configurations will depend on the specific application in which the systems and techniques of the invention are used. Those skilled in the art should also recognize or be able to ascertain, using no more than routine experimentation, equivalents to the specific embodiments of the disclosure. It is therefore to be understood that the embodiments described herein are presented by way of example only and that, within the scope of the appended claims and equivalents thereto; the invention may be practiced otherwise than as specifically described.

Moreover, it should also be appreciated that the disclosure is directed to each feature, system, subsystem, or technique described herein and any combination of two or more features, systems, subsystems, or techniques described herein, if such features, systems, subsystems, and techniques are not mutually inconsistent, is considered to be within the scope of the disclosure as embodied in the claims. Further, acts, elements, and features discussed only in combination with one embodiment are not intended to be excluded from a similar role in other embodiments.

As used herein, the term "plurality" refers to two or more items or components. The terms "comprising," "including," "carrying," "having," "containing," and "involving," whether in the written description or the claims and the like, are open-ended terms, i.e., to mean "including but not limited to." Thus, the use of such terms is meant to encompass the items listed thereafter, and equivalents thereof, as well as additional items. Only the transitional phases "consisting of" and "consisting essentially of," are closed or semi-closed transitional phrases, respectively, with respect to the claims. Use of ordinal terms such as "first," "second," "third," and the like in the claims to modify a claim element does not itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

What is claimed is:

1. A method of facilitating electrolytically depositing a metal onto a conductive substrate, the method comprising:

depositing a metal onto a conductive substrate from an electrolyte including an ionic form of the metal and one or more organic additives in an electrodeposition vessel by applying a current through the electrolyte from an anode to the conductive substrate; and wherein the anode includes:

a core comprising titanium, an interlayer disposed on the core and comprising one of a titanium-tantalum alloy comprising titanium and tantalum in a weight ratio of 30:70 to 70:30, a titanium-palladium alloy, titanium grade 7, titanium grade 7H, titanium grade 11, titanium grade 16, titanium grade 16H, titanium grade 17, or titanium grade 19, wherein the interlayer has a metal loading of about 0.2 $g/m^2$ to about 3.5 $g/m^2$; and a catalyst material layer disposed on the interlayer and comprising iridium and tantalum in a mass ratio of 9:1 to 2:1.

2. The method of claim 1, wherein the anode core comprises one of titanium grade 1 or titanium grade 2.

3. The method of claim 1, wherein the electrolyte includes an aqueous solution including one of chromium ions, tin ions, zinc ions, or copper ions.

4. The method of claim 3, wherein the aqueous solution includes chromium ions and is maintained under conditions in which the chromium ions exist predominantly as Cr (III).

5. The method of claim 4, further comprising maintaining a pH of the electrolyte between 0 and 4.

6. The method of claim 1, wherein the catalyst material layer further comprises one or more of platinum, ruthenium, ruthenium oxide, or palladium, tantalum, or tantalum oxide.

7. The method of claim 1, wherein the anode is configured to pass over 50 MAh per $m^2$ of anode area prior to failure of the anode.

8. The method of claim 1, wherein the electrolyte further includes one of a sulfuric acid or a sulfonic acid.

9. The method of claim 1, wherein the interlayer comprises the titanium-tantalum alloy comprising titanium and tantalum in a weight ratio of 40:60 to 60:40.

* * * * *